United States Patent [19]

Gostelow et al.

[11] 4,137,732

[45] Feb. 6, 1979

[54] YARN FEED AND YARN CHANGE MECHANISM

[75] Inventors: Daniel W. F. Gostelow; Peter M. Findlay, both of Leicester, England

[73] Assignee: Wildt Mellor Bromley Limited, Leicester, England

[21] Appl. No.: 833,263

[22] Filed: Sep. 14, 1977

[30] Foreign Application Priority Data

Sep. 18, 1976 [GB] United Kingdom ..... 38792/76

[51] Int. Cl.[2] ..... D04B 15/60

[52] U.S. Cl. ..... 66/140 R; 66/145 R; 66/125 R

[58] Field of Search ..... 66/125 R, 145 R, 140 R, 66/140 S

[56] References Cited

U.S. PATENT DOCUMENTS

| | | | |
|---|---|---|---|
| 3,079,779 | 3/1963 | Butler et al. | 66/145 R X |
| 3,494,151 | 2/1970 | Baker et al. | 66/140 S |
| 3,832,868 | 9/1974 | Derich et al. | 66/125 R X |
| 3,890,809 | 6/1975 | Tenconi | 66/140 R |

FOREIGN PATENT DOCUMENTS

| | | | |
|---|---|---|---|
| 1069813 | 11/1959 | Fed. Rep. of Germany | 66/125 R |
| 377972 | 7/1964 | France | 66/145 R |
| 926857 | 5/1963 | United Kingdom | 66/125 R |

*Primary Examiner*—Werner H. Schroeder
*Assistant Examiner*—Andrew M. Falik
*Attorney, Agent, or Firm*—Buell, Blenko & Ziesenheim

[57] ABSTRACT

Pneumatic yarn feed and yarn change mechanism has a plurality of yarn feed paths and a plurality of control elements for controlling passage of yarn for each of these paths independently. Flow of fluid through selected yarn feed passage when the control element is in a feed position propels leading end of yarn to knitting needles. Movement of control element out of feed position to trap position causes yarn to be severed and trapped and held in readiness for subsequent selection.

In a preferred embodiment side by side control plates are moved pneumatically by pistons arranged one above the other.

18 Claims, 12 Drawing Figures

YARN FEED AND YARN CHANGE MECHANISM

FIELD OF INVENTION

The invention relates to yarn feed and yarn change mechanisms for use in knitting machines to supply yarn or a number of yarns in a sequence to needles of a knitting machine. The invention is applicable especially to circular knitting machines with needles arranged in a revolving cylinder to move past a stationary yarn feed and change mechanism of the invention but may also be applied to circular knitting machines in which a yarn feed and yarn change mechanism of the invention and associated cam system revolve around a stationary needle cylinder and to flat bed knitting machines.

BACKGROUND OF INVENTION

Pneumatic yarn feed devices are described in the Bristish Patent Specification No. 1,426,024. Such devices require external yarn cutting devices. Other devices having internal yarn cutting and trapping arrangements are described in the West-German Auslegeschrift No. 1,069,813. Such devices required complicated control arrangements to synchronise successive operations during a yarn change. This problem is particularly troublesome when a large number of such devices is arranged around a knitting machine. The time required for a yarn change is long and may differ depending on the particular yarn selected.

It is the object of the invention to provide a yarn feed and change mechanism capable of changing yarns quickly which is easily controlled and can be used at a plurality of positions around the knitting machine.

DESCRIPTION OF INVENTION

According to the invention, there is provided a yarn feed and change mechanism which includes a plurality of yarn feed passages for feeding different yarns, means for providing a flow of fluid through the yarn feed passages for propelling a leading end of a yarn to knitting needles, a plurality of control elements each with a yarn control passage, each element being movable to a feed position in which the control passage forms a continuation of the associated yarn feed passage to permit yarn to be fed and to a trap position for co-operation with severing and trapping means to sever and trap the yarn in the control passage, the elements being movable individually to enable more than one yarn control passage to be in the feed position simultaneously.

A yarn change can be effected without interrupting a course being knitted by moving one additional element into the feed position when another element is already in the feed position and then moving that other element into the strap position. The length of time during which two elements may be in the feed position may be controllable for the purpose of varying the overlap between the leading end of a new yarn and the trailing end of an old yarn or for the purpose of feeding two yarns to the needles continuously. The severing may be effected by cutting. Severing and trapping is synchronized inherently with the return of the element from the feed position.

Suitably the yarn feed passage include each a portion upstream from the yarn control passage with a stationary inlet to facilitate threading up. Preferably the upstream portion has an inlet for compressed air to enable fluid to be passed at a high velocity in a downstream direction to propel the leading yarn end.

Advantageously, the yarn control passage is of a reduced cross-section compared with that of the yarn feed passage portion upstream so that the fluid flows at a higher velocity through the yarn control passage than through the upstream portion. The yarn control passage cross-section may be from 5 to 10% smaller than that of the upstream portion. In this way the propelling force of the fluid flow acts initially most strongly on the leading yarn end in the control passage. Preferably the elements are reciprocable between the feed and the trap position, and are slidable.

Preferably the yarn feed passage and the element are contiguous so that substantially no fluid can escape sideways away from the passages. Suitably recesses are provided at the ends of the yarn control passage to avoid snagging or sticking of yarn to the element or the surfaces surrounding the ends of the yarn control passage.

Preferably the element is mounted slidably between opposed guide surfaces biassed towards one another so as to hold the element in position frictionally but permit it to move easily once actuated. Advantageously one guide surface, upstream of the element, forms a trapper and another guide surface, downstream of the element cooperates with the control element to cut the yarn. The leading end of the yarn hangs in the yarn control passage in the trap position. A bias urging the trapper toward the control element may be provided by means of a spring.

Suitably the elements block flow of fluid in a downstream direction through the yarn feed passages when in the trap position. Preferably the elements are connected to a yarn storage device so that a store of yarn is formed upstream of the yarn control passage on moving the elements into the trap position which store is released by moving the elements into the feed position. The yarn storage device may include a lever having yarn guides for drawing a store of yarn at one end and engaging the element at the other end.

The elements may be movable by a mechanically, electrically, hydraulically or pneumatically operated actuating means including pneumatically operated piston and cylinder devices. Advantageously the actuating means is adapted in one mode of operation to return an element already in the feed position to the trap position after another element has been moved from the trap position to the feed position. In this way the actuating means need only be controlled to move the appropriate element into the feed position so as to effect a yarn change and need not be controlled separately to move the element already in the yarn feed position into the trap position. Conveniently the actuating means are adapted to provide a further second mode of operation in addition to and as an alternative to said one mode of operation, the second mode of operation serving to return any element already in the feed position into the trap position without moving any other element from the trap position to the feed position. In this way a course can be terminated. Conveniently the actuating means are arranged to change the element position and are not responsible to maintain the element in the feed position or in the trap position.

Preferably the actuating means are pneumatic and employ fluid pressure such as compressed air. This enables the elements to be moved quickly and with sufficient force to effect severing and trapping. Conveniently the actuating means include a pair of pistons for each element operating in cylinders arranged in pairs to move the elements individually in opposite senses. Individual air inlets may be provided to the cylinders to move the elements. Preferably an intercommunicating passage for fluid is provided extending from inlets connected to the cylinders with first pistons (for moving the elements into the feed position) to a chamber connected to the cylinders with second pistons for moving the elements out of the feed position so that, when a first piston moves its associated element towards the feed position, fluid under pressure may pass through the intercommunicating passage to return any elements already in the feed position to the trap position. Suitably a manifold passage is provided for supplying air to the intercommunicating passage when one of the first pistons is moved appropriately. Conveniently the manifold passage and intercommunicating passage can be connected by a passage formed in the first pistons.

Preferably the first and second pistons are aligned and are adapted to bear against opposite end faces of the elements slidably mounted between the first and second pistons. Suitably the elements are adapted to block fluid flow through the associated yarn feed passages when in the trap position. Preferably fluid is supplied to all yarn feed passages from a common manifold but fluid flow is inhibited through all passages except any whose associated elements are in the yarn feed position.

Fluid for passing through the yarn feed passages and for operating the actuating means may be derived from a common source and its delivery controlled through solenoid operated valves. Conveniently the solenoid drivers are controlled by timing devices so as to provide a predetermined sequence of operation of the valves. The solenoids may be operated in response to a selecting arrangement (which may be electric, photocell operated or mechanical) operable in synchronisation with knitting.

The yarn feed and change mechanism is compact in construction. The to and fro movement of the reciprocable elements can be used to bring an element into an active feeding position and the withdrawal from the active position will lead simultaneously and automatically to a cutting and trapping of the yarn. The movement of the elements may also be used to influence the flow of fluid through the feed passages and to build up or release a store of yarn so that the mechanism can be controlled easily. The pistons, elements and yarn storage devices may be the only moving parts and yarns may be changed quickly. Because the individual elements are moved, the selection of the yarn sequence is not limited or restricted by the actuating mechanism but only by the selecting arrangement. More than one element may be brought into the feed position.

The invention may be modified to provide other constructions which differ in detail from what has been described in the foregoing. Separate elements may be provided for yarn cutting and trapping. Cutting may then take place somewhere along the yarn feed passages whereas trapping occurs upstream of these passages. The elements may be pivotable and not slidable. The actuating means may have a single piston operable in opposite directions joined with the element for sliding it to and fro. The return movement to the trap position may be caused by fluid under pressure supplied to the second piston after passing from an inlet for fluid to the cylinder with the first piston through a passage with a one-way valve to the intercommunicating passage. A separate manifold for supplying fluid for the return movement would then not be needed. The one-way valves would prevent flow in reverse from the second pistons to the first pistons. A single piston operable by fluid under pressure in one direction only may also be used. The return movement can be provided by a spring. The actuating means may then have a pneumatic circuit adapted to maintain fluid pressure during feeding of yarn to keep the element in the feed position.

Advantageously pistons at one end are selectively operable to move the associated control elements to the feed position and a separately controllable source of pressurized air is provided for returning all the control elements at the other end to the trap position, return of a selected control element being prevented by counterbalancing supply of pressurized air to the piston at said one end. To enable compact overall construction, conveniently the pistons are arranged one above the other and actuate the control elements by means of pins at least some of which are arranged eccentrically with respect to the pistons. Trapping and cutting can be more postively controlled if the control element is adapted to engage an extension from the trapper to positively release or apply the trapper when the control elements move into or out of the feed position and the control element has a recess containing a cutter member resiliently urged downstream to cut the yarn.

The invention is more particularly described with reference to the drawings in which.

GENERAL CONSTRUCTION

Figure 1:
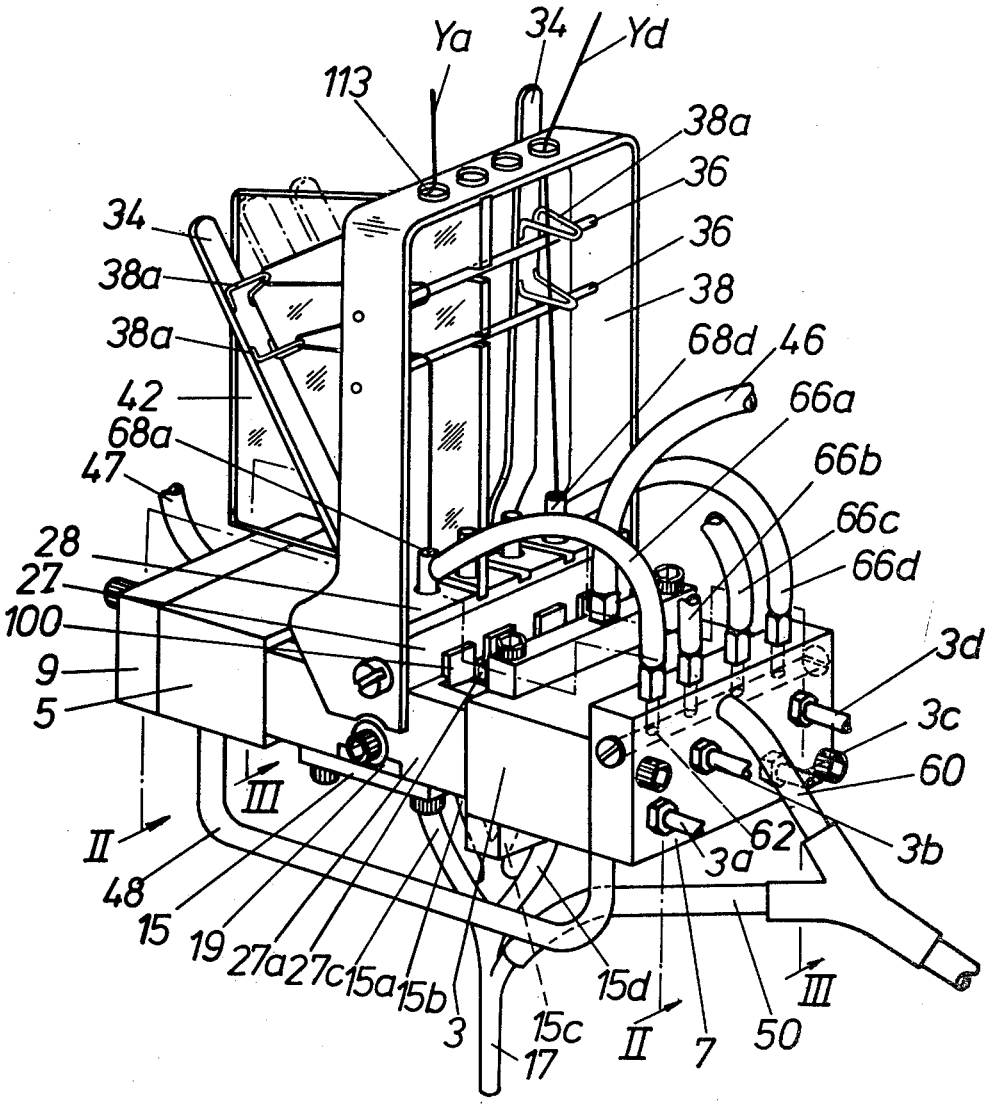
FIG. 1 is a perspective view of a yarn feed and yarn change mechanism of the invention, with only two yarns Ya and Yd shown for clarity.

With reference to the Figures, a yarn feed and change mechanism 1, referred to herein for brevity as a "striper 1", includes a number of components which can be grouped in accordance with their function in the striper 1 under four headings:

a — yarn cutting and trapping components including a cutting plate 19, sliding blocks 21 and trapping blocks 25;

b — yarn supplying guide components upstream of the yarn cutting and trapping components;

c — yarn feeding guide components downstream of the yarn cutting and trapping components; and d — actuation components to move the sliding blocks 21.

The actuation components include those forming passages for air which are a first part of a pneumatic circuit. The pneumatic circuit has a second part remote from the striper 1 associated with an electronic control arrangement shown in FIG. 4.

The striper 1 may be fitted on a knitting machine (not shown) with a main yarn feed tube 17 directed towards needles of the knitting machine. The striper may be spatially orientated with respect to the knitting machine as convenient but the striper 1 is described herein as being in the position shown in FIG. 1, with the yarn supplying guide components uppermost.

*The yarn cutting and trapping components* are arranged to provide four separate yarn cutters and trappers. Each yarn cutter and trapper includes: a helical spring 30 retained by a top plate 28 (common to all cutters and trappers) in cylindrical holes in a mounting bracket 27 (common to all cutters and trappers); the trapping block 25 retained in a recess 27*c* in the bracket 27, urged downward by the spring 30 and restrained against horizontal movement by lugs 100 bearing against a front and rear surface of the bracket 27; the sliding block 21 retained in the recess 27*c* which block 21 is movable horizontally; and the cutting plate 19 (common to all cutters and trappers) bolted to sides 27*a* and 27*b* of the bracket 27. Each yarn cutter and trapper further includes a yarn guide tube 68 extending through the plate 28 and axially through the spring 30 to the block 25. The guide tube 68 defines part 102 of a yarn feed passage. The block 25 has a narrow passage 104 aligned with the yarn feed passage with a rounded lower edge 105. The block 21 has a narrow passage 106 with a wide recess 108 at the top slightly, arranged eccentrically with respect to the passage 106. The recess 108 has a rounded upper edge 109. The passage 106 can be moved by sliding the block 21 into and out of alignment with the passage 104. The cutting plate 19 has associated with each cutter and trapper, a narrow passage 110 with a wide concentric recess 112 at the top. The recess 112 has a sharp edge 20. The lower outlet of the passage 106 in the block 21 is flush with its lower surface which slides over the surface of the cutting plate 19.

Figure 2:
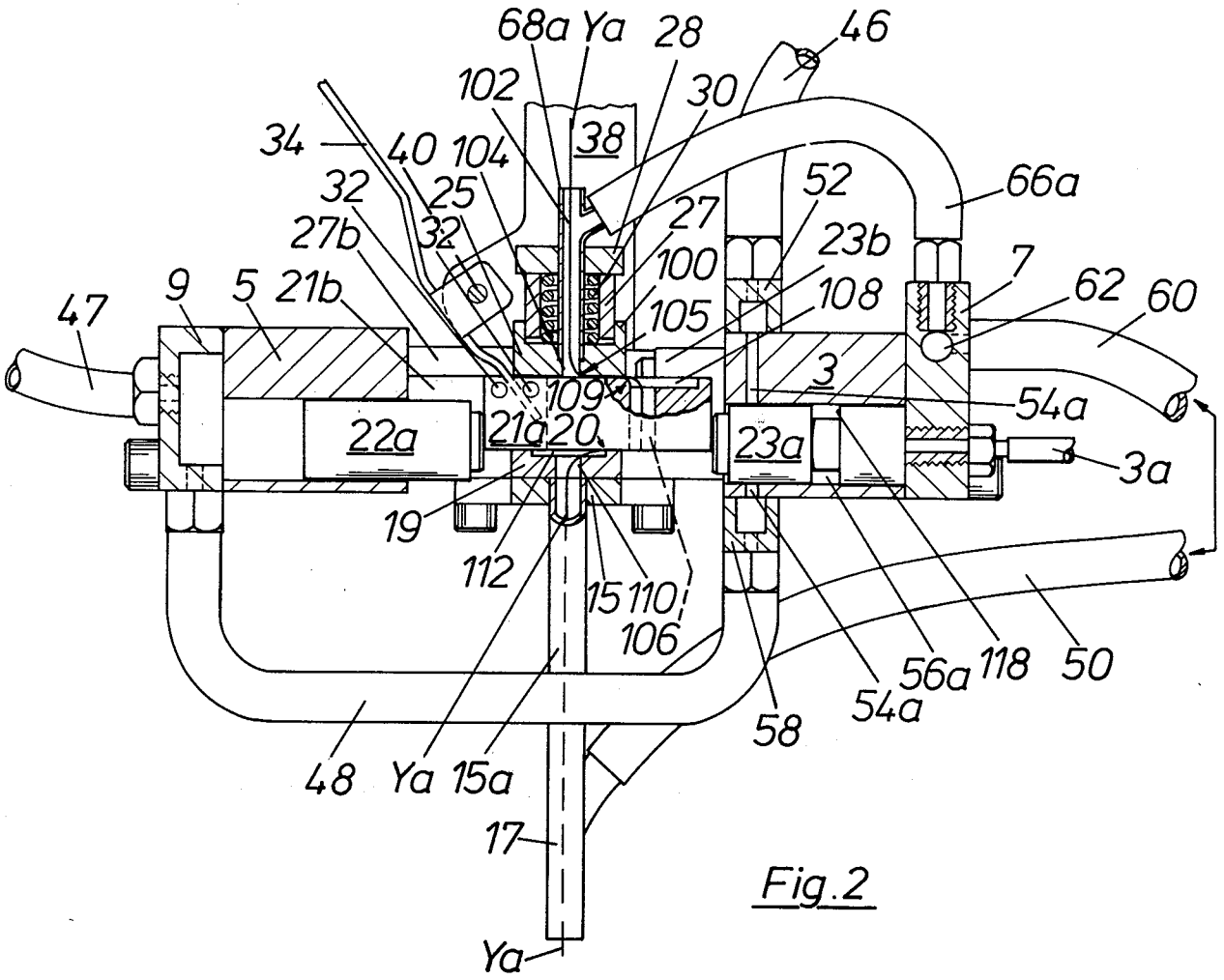
FIG. 2 is a section along line II—II of FIG. 1 with the components which are shown in section in a yarn trapping configuration.
Figure 3:
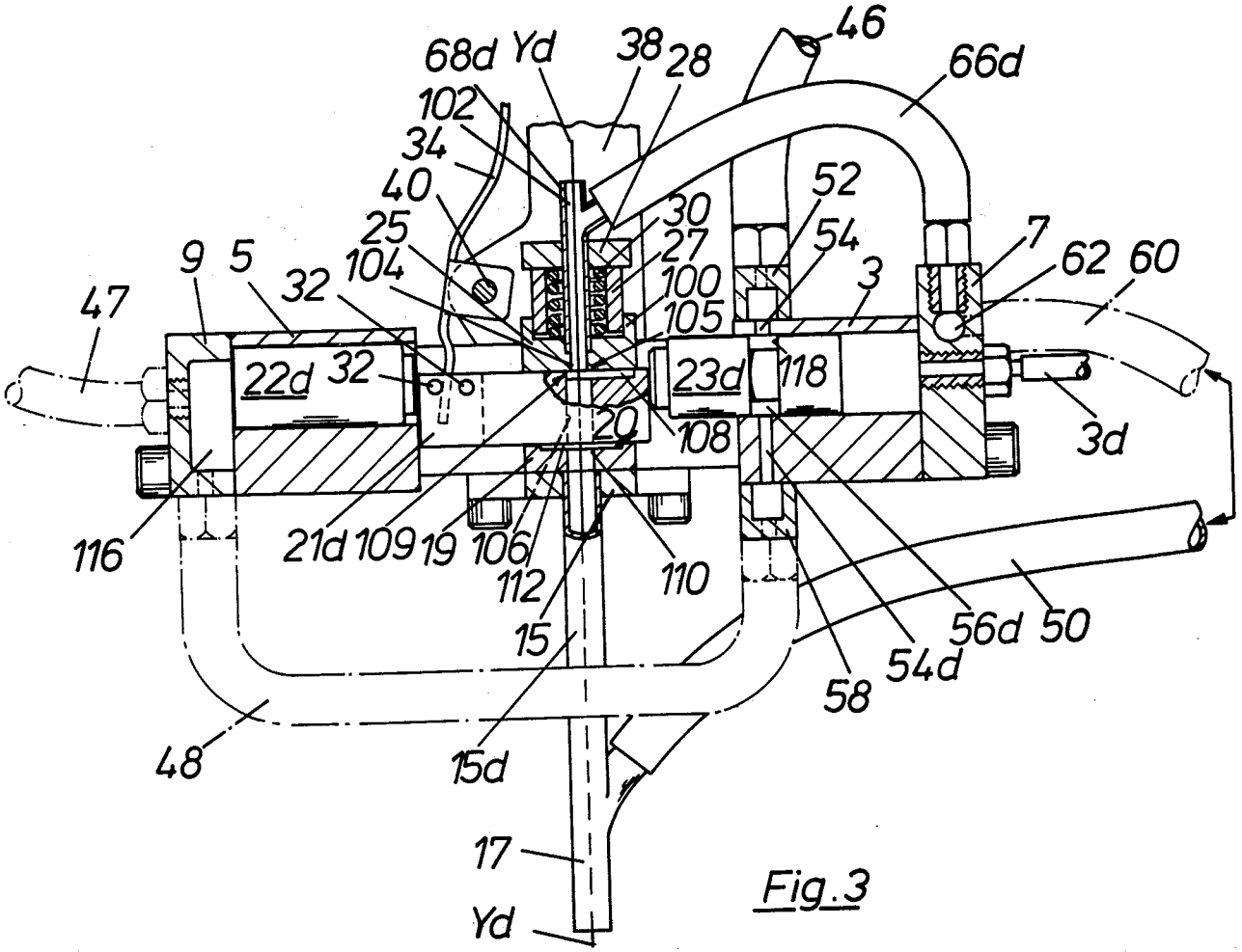
FIG. 3 is a section along line III—III of FIG. 1 with the components which are shown in section in a yarn feeding configuration.

FIG. 3 shows a cutter and trapper in a yarn feed configuration with the guide tube 68, the passage 104 in the trapper block 25, the passage 106 in the sliding block and the passage 110 in alignment. On moving the sliding block 21 to the trapping configuration shown in FIG. 2 from the yarn feeding configuration, the following events will occur in succession:

1. the rounded edges 105 and 109 will meet and cause the yarn to be trapped without damaging it between the trapper block 25 and the upper surface of the sliding block 21. The block 25 is slightly lifted against the pressure of the spring 30, after a delay.
2. the sharp edge 20 will meet the oppositely facing part of the edge of the lower outlet of the passage 106 and cut the yarn.

On reversing the movement the recess 108 will reduce the risk of accidentally re-trapping the yarn. The sliding blocks 21 lie closely together so forming a compact arrangement.

*The yarn supplying guide components* upstream of the yarn cutters and trappers are arranged to provide four independently operable yarn guide and storage devices, one such device being associated with each cutter and trapper. Each yarn guide and storage device includes: a pair of vertically spaced bars 36 (common to all devices) mounted between the sides of a bracket 38 screwed to the aforementioned bracket 27; a yarn storage lever 34 pivotably mounted at 40 onto the bracket 38; a pair of yarn guides 38*a* on the lever 34; a lever extension of the lever 34 received between transverse pins 32 mounted across a recess in the associated sliding block 21; and a guide eye 113 in the top of the bracket 38. The yarn guide and storage devices are separated by transparent partitions 42 (only one of which is shown for clarity) slidably received at the top in slots in the bracket 38 and, at the bottom, in the top plate 28.

In the aforementioned yarn feed configuration (see FIG. 3), the lever 34 is held vertically by the pins 32 in the sliding block 21 with the yarn guides 38*a* projecting to the front of the bars 36 so as to provide a straight vertical path for yarn through the guide eye, between the bars 36 and the guides 38*a* to the associated yarn guide tube 68.

In the trapping configuration (see FIG. 2), the lever is held at an inclined angle by the pins 32 so as to provide a zig-zag yarn path for storage purposes. The path extends through the guide eye in the bracket 38, through the guides 38*a* on one side and the bars 36 on the other side to the associated yarn guide tube 68. The store of yarn formed by the lever 34 is released automatically as the sliding blocks 21 move to the yarn feeding position.

*The yarn feeding guide components* downstream of the yarn cutters and trappers include a bottom plate 15 (common to all cutters and trappers) screwed to the sides 27*a* and 27*b* of the bracket 27 and four yarn guide tubes 15*a* to 15*d* fastened to the bottom plate 15, each aligned with the associated passage 110 in the cutter plate 19. The four tubes 15*a* to 15*d* merge into the single, main yarn feed tube 17. Any yarn, whether passing through the tube 15*a*, 15*b*, 15*c* or 15*d* will thus proceed into the tube 17. As the sliding blocks 21 are closely together, the respective lengths of the tubes 15 are approximately the same and the striper 1 can be mounted in a confined space to enable the yarns to be fed from a single feed position.

*The actuation components* for moving the slide blocks 21 include a piston block 3 at the front of the bracket 27; a piston block 5 at the rear of the bracket 27; a manifold end plate 7 with a manifold 62 attached to the front of the block 3; a manifold end plate 9 with a manifold 116 attached to rear of the block 5; an upper manifold block 52 on the top of the block 3; and a lower manifold block 58 on the bottom of the block 3. Associated with each of the cutters and trappers there are further provided: a piston 23 retained in a cylinder in the block 3, which piston 23 has an annular groove 118 and bears against the front end of the sliding block 21; and a piston 22 retained in a cylinder in the block 5 and bearing against the rear end of the sliding block 21. The pistons 22 and 23 are arranged in line to act in opposite directions. The overall arrangement of the four sets of pistons 22 and 23 is made compact by arranging them in vertically spaced, laterally off-set pairs. The striper 1 provides the following parts of a pneumatic circuit common to all cutters and trappers: an air inlet tube 47 connected to the manifold 116; an air inlet tube 46 connected to the manifold block 52 and through upper passages 54 to the cylinders with pistons 23; an air inlet tube 60 connected to the manifold 62; a tube 48 interconnecting the manifold 116 and the manifold block 58 which is connected through further lower passages 54 to the cylinders with the pistons 23; and an air supply tube 50 connected to the main yarn feed tube 17. The striper 1 further has the following parts or features associated individually with each cutter and trapper: an air inlet tube 3a–3d connected to a cylinder for one of the pistons 23; a tube 66 interconnecting the manifold 62 to each of the yarn guide tubes 68 and passages 54 for interconnecting the manifold block 52 and 58 in the yarn feeding configuration of the cutter and trapper. The movement from the trapping to the feeding configuration requires shifting of the pistons 22 and 23, the sliding blocks 21 and the lever 34. All these components are of a low mass.

*The electronic control arrangement* includes a pattern band 74 racked around at intervals in synchronisation with the progress of knitting by toothed drive wheel 74a engaging drive opening 74b in the edge of band 74. Holes are punched into the band 74 to activate the appropriate photocells R1 to R6. Each photocell is adapted to provide an input through a buffer amplifier B/A to a preset timer P/T which in turn activates a solenoid driver for any one of valves S1, S1a to S6 for a predetermined period. One preset timer P/T has an alternative input from a manual switch MC and operates a valve S6 for supplying air to the air inlet tube 47. Four other individually operable valves S2 to S5 control the supply of pressurised air to the different air inlet tubes 3a–3d. The valve S1 controls the flow of air to the air inlet tube 60 and the air supply tube 50 and the valve S1a controls air flow to the air inlet tube 46.

The compressed air whose flow is controlled by the aforementioned valve is derived from a common source PS. Any impurities in the compressed air are removed by a filter F and a mist of lubricating oil is introduced by an oiler O.

The pattern of the striper operation can be altered by simply changing the band 74.

OPERATION

The operation is described where necessary by attaching a letter (a, b, c, or d) to the numeral indicating a particular component. The letters so added are used to identify and distinguish the four different cutters and trappers and associated components for yarn guiding, storing or actuation.

YARN CHANGE

Figure 4:
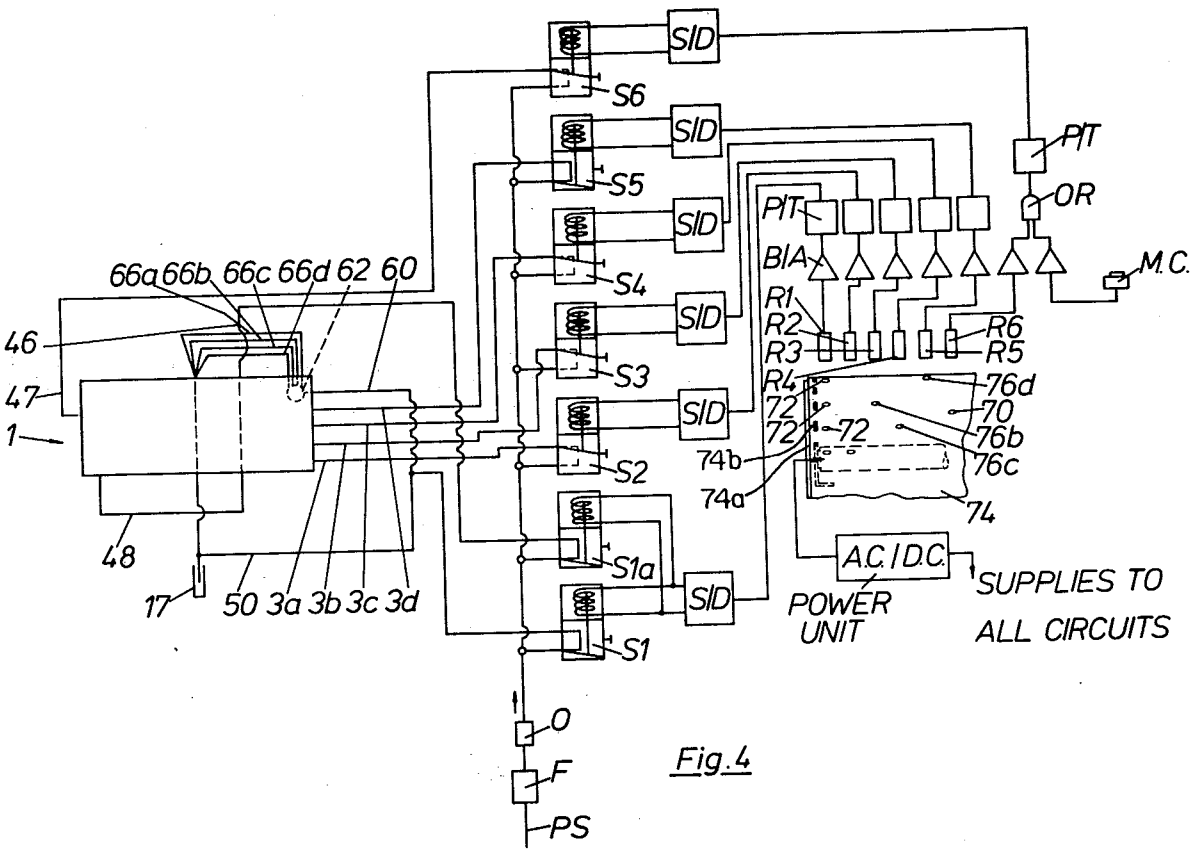
FIG. 4 shows a pneumatic and electronic circuit associated with the mechanism of FIG. 1 which mechanism is indicated schematically in FIG. 4.

Assuming that the striper 1 is in the position shown in FIG. 1 as a result of the instructions on the band 74 derived from the hole 70 as seen in FIG. 4 and the hole 76d, the striper 1 operates as follows. The sliding blocks 21a, 21b and 21c and the associated levers 34a, 34b and 34c are in the trapping configuration with their yarns Ya, Yb and Yc trapped between the respective trapper block 25 and the upper surface of the sliding blocks 21 with the leading end hanging down into the passage 106. Lengths of the yarns Ya, Yb and Yc are stored in zig-zag paths defined by the guides 38a and the bars 36. No yarn is present in the tubes 15a, 15b and 15c. All valves S1 to S6 are closed. The sliding block 21d and its associated lever 34d are in the yarn feed configuration with the yarn Yd passing unobstructed in a straight path through the guide eye 113d, the guides 38a, the guide tube 68d, the passages 104, 106 and 110, and through the tubes 15d and 17 to needles of a knitting machine.

When the band 74 is racked around further during knitting the hole 76b is advanced under the photocell R3 and its adjacent hole 72 is advanced simultaneously under the photocell R1. As a result a signal is supplied to the appropriate buffer amplifiers B/A and an input provided to trigger the connected preset timers P/T. These can provide an output pulse for a predetermined duration after a controlled delay so that the band 74 can remain in place and the holes 72 and 76b dwell under the photocells R1 and R3 or be advanced further immediately while the initiated yarn change is still in progress.

The output of the preset timers P/T then energise the solenoid drivers S/D controlling the valves S1, S1a and S3 to provide the following operation. The valves S1a and S3 are opened first simultaneously.

The opening of the valve S1a causes air to be supplied to the air inlet tube 46, the manifold block 52 and hence to the upper passages 54a, 54b, 54c and 54d. The passage 54d is initially the only one which communicates through the annular groove 118d with the lower passage 54d and hence the manifold block 58, the tube 48 and the manifold 116.

A premature return movement of the block 21d is not possible as a result of the air pressure in the manifold 116 at this initial stage because such movement would cut off the flow of air through the groove 118d before any cutting or trapping occurred. The piston 23d would move at most only slightly to the right until it reached a position of balance.

Where the passage 106 is narrow, the slight rightward movement may lead to the passage of yarn being obstructed. This can be avoided by interposing a resilient element between the piston 23 and the block 21 which is compressed on moving the piston to the left and then expands to move the piston 23 to the right but not the block 21. In this way the passage 106 remains aligned with the tube 68 even whilst the flow of air through the passages 54 is cut off by the piston 23. This modification will prevent any flow of air to the manifold unless a resilient element is compressed by air pressure from one of the inlet tubes 3a to 3d. The description which follows relates to a construction as shown without such resilient elements.

Opening of the valve S3 causes air to be supplied through the inlet tube 3b to shift the piston 23b and the sliding block 21b to the left (as seen in FIGS. 2 and 3) out of the trapping configuration and into the yarn feeding configuration. The yarn Yb is thus untrapped and the store of yarn formed by the lever 34b is released. After the sliding block 21b has been shifted to the left air passes through the passage 54b to the manifold 116.

After a delay, sufficient to permit the sliding block 21b to reach the yarn feeding configuration, the valve S1 is opened. The opening of the valve S1 causes air to be blown through the inlet tube 60, the manifold 62 and the tubes 66a, 66b 66c and 66d (note that all tubes 66 are used) down into the guide tubes 68a, 68b, 68c and 68d. Opening of the valve S1 also causes air to be blown through the air supply tube 50 down into the main yarn feed tube 17. The blocks 21a and 21c obstruct the flow of air down into the tubes, 15a and 15c so that downward airflow is induced through the guide tubes 68b and 68d, through the passages 106b and 106d into the tubes 15b and 15d. The store of yarn Yb released by the upward pivotal movement of the lever 34b is thus blown by an air blast through the tube 17 to the knitting needles.

The continuing air pressure in the manifold 116 provides that all pistons 22a, 22b, 22c and 22d are urged to the right as seen in FIG. 2. The valve S3 is still open and the pressure of air supplied by it exceeds that supplied through the inlet tube 46. Thus movement to the right of the piston 22*b*, the block 21*b* and the piston 23*b* is resisted. The pistons 22*a* and 22*c* are already in their right-most position. The valve S5 is shut and so the piston 22*d*, the sliding block 21*d* and the piston 23*d* are shifted to the right as soon as the sliding block 21*b* has been shifted to the left and the air pressure in the manifold 116 would no longer be cut off by the return movement of the block 21*d* and the piston 23*d*. This movement to the right is very quick and any restraints on the supply of yarn are only momentary and are compensated by the yarn elasticity and and slack in the yarn. The movement to the right has the following consequences:

1. The trapping shoulders 109 and 105 meet and the trapping of the yarn Yd commences. The yarn Yb is now being blasted towards the knitting needles. The lever 34*d* starts to form a store of yarn by drawing extra yarn from upstream of the striper 1, whilst the yarn Yd is still being drawn by the knitting needles.

2. The yarn Yd is next fully trapped and is then cut by the edge 20 and the outlet of the passage 106*d*. The yarn Yd is secured in the knitting needles before the yarn Yd is cut. The lever 34*d* continues to form a store of yarn from upstream whilst the lower cut end of the yarn Yd is trapped.

Knitting is thus continued without interruption. The valve S3 can now be shut. The pneumatic circuit thus prevents accidental "press-offs" and automatically coordinates the various piston movements.

Subsequently the valves S1 and S1*a* are shut. The striper 1 is now ready for a subsequent selection. The striper 1 can be similarly actuated to change to yarn Ya and Yc. Thus the various yarns may be fed in accordance with patterning requirements without any restriction on the yarn sequence. Each change requires the same type of actuation and is performed in the same span of time, about 500 milliseconds or so. The store of yarn is released where necessary automatically in synchronization with the yarn change and this operation requires no separate control or actuating mechanism.

INTERRUPTING YARN FEEDING

The striper 1 can be operated to interrupt yarn feeding (either for pressing off a fabric or to provide an arc of the needle cylinder devoid of yarn or fabric) automatically by advancing the band 74 to place a hole 70 under the photocell R6. The solenoid controlling the valve S6 is energised and air supplied to the air inlet tube 47 whilst all other valves S1, S1*a*, S2, S3, S4 and S5 remain shut. Compressed air entering the manifold 116 causes any piston 22 in the yarn feed attitude to move to the right as seen in FIG. 2 to cut and trap the yarn previously fed without any new yarn being introduced. This operation can also be performed by operating the manual switch MC.

INTRODUCING A YARN TO START YARN FEEDING

All cutters and trappers are at the start of such an operation in the trapping configuration. A yarn Yc can be introduced by advancing the hole 76*c* on the band 74 and the associated hole 72 under the photocells R4 and R1 respectively. The sliding block 21*c* is moved over to the left as during a yarn change and an air blast sends the leading end of the yarn Yc, whose stored part is now released, down the tube 17 to the needles. The compressed air supplied through the inlet tube 46 is without effect in this case.

SETTING-UP

The lever 34 of the cutter and trapper to be threaded is held vertically by hand. This places the sliding block 21 in the yarn feeding configuration shown in FIG. 3. A yarn can then be inserted through the guide eye 38*a* past the front of the bars 36 into the yarn guide tube 68 and through the passages 104, 106 and 110 into the associated tube 15*a*, 15*b*, 15*c* or 15*d*. An operator then switches the manual switch MC (see FIG. 4). The appropriate valve S6 then opens to move all sliding blocks 21 to the yarn trapping configuration. Automatic control of the striper as described previously can now commence.

TIMING

The extent of the overlap between the leading end of the new yarn and the trailing end of the old yarn can be varied as follows. If it is not desired to return the old sliding block in the feed position to the trap position, immediately after a new sliding block has been moved to the feed position, air can be supplied to the inlet tube for the piston 23 associated with the old sliding block for the length of time it is required to hold that block in the feed position. The pressure will cause the old sliding block to resist the pressure built up in the manifold 116 due to the arrival of the new sliding block in the feed position. After the required lapse of time the inlet tube can be disconnected from the pressure source and the old sliding block will move to the trap position. During the operation the air must be supplied continuously to the piston 23 for the new sliding block.

More than one sliding block can be left in the feed position by similarly resisting the return movement of an old sliding block and interrupting the compressed air supply to the pistons 23 of both blocks 21 at the same time.

FIRST MODIFIED CONSTRUCTION

Figure 5:
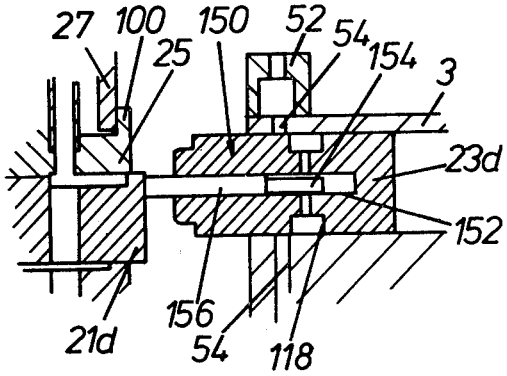
FIG. 5 shows a section through modified part of the yarn feed and yarn change mechanism of FIG. 1.
Figure 6:
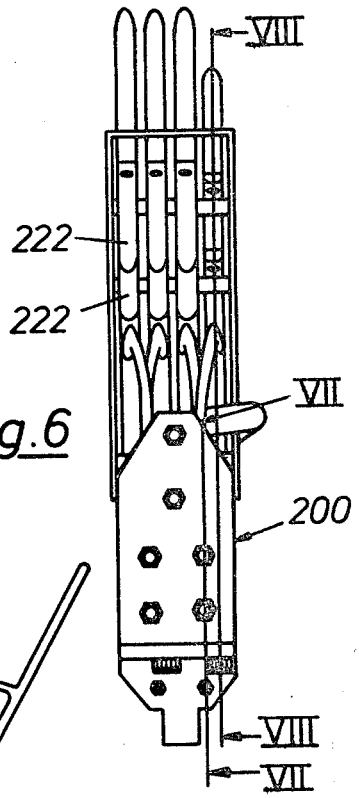
FIG. 6 shows an end view of another yarn feed and yarn change mechanism of the invention.

With reference to FIG. 5, a more reliable operation can be obtained using modified pistons 23. A piston core element 150 is received in a central bore 152 in the piston 23*d*. The core element 150 has a triangular sectioned rear part 154 and a circular sectioned front part 156. The bore 152 is connected by radial passages to the groove 118. The core element functions as follows.

In the trap configuration the core element 150 is wholly inside the bore 152. If air were supplied to the inlet 3*d*, the piston 23*d* would be pushed to the left and allow air to pass through the piston into the bore 152 and through the groove 118 from the upper passage 54*d* to the lower passage 54*d*.

If air was continued to be supplied through the inlet tube 3*d*, the core element 150 would remain retracted and air supplied to the manifold 116.

If air were no longer to be supplied through the inlet tube 3*d*, the air pressure in the bore 152 would push the piston 23*d* to the right leaving the element 150 projecting from the bore as shown in FIG. 5. Thus air could no longer pass through the groove 118*d* and the piston 23*d* would come to rest in the position shown in FIG. 5.

The sliding block 21*d* can then only be returned by air from the inlet tube 47 or by another piston 23 being pushed to the left to pressurize the manifold 116.

Using the modification the sliding blocks 21 can remain in the feed position whilst air flow through the associated grooves 118 is cut off.

The triangular sectioned part seats firmly in the bore 152 without preventing the air pressure from building up in the bore 152.

SECOND MODIFIED CONSTRUCTION

With reference to FIGS. 6 to 12, another form of yarn feed and yarn change mechanism includes a first selectively operable piston and cylinder assembly 200, a yarn cutting and trapping assembly 202 and a second return piston and cylinder assembly 204.

The assemblies 200 and 204 contain four cylinder bores 206 and 208 respectively arranged in pair one above the other. The assemblies operate yarn control plates 210 through pins 211 arranged eccentrically with respect to the pistons 212 and 214 respectively (see FIG. 11). This arrangement permits close packing of the cylinder bores 206 and 208. Each pair of aligned, oppositely acting pins 211 actuate one of the plates 210.

Figure 10:
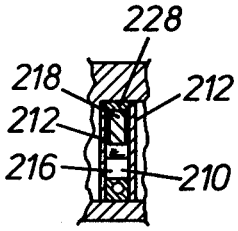
FIG. 10 shows a section along line X—X in FIG. 9.
Figure 9:
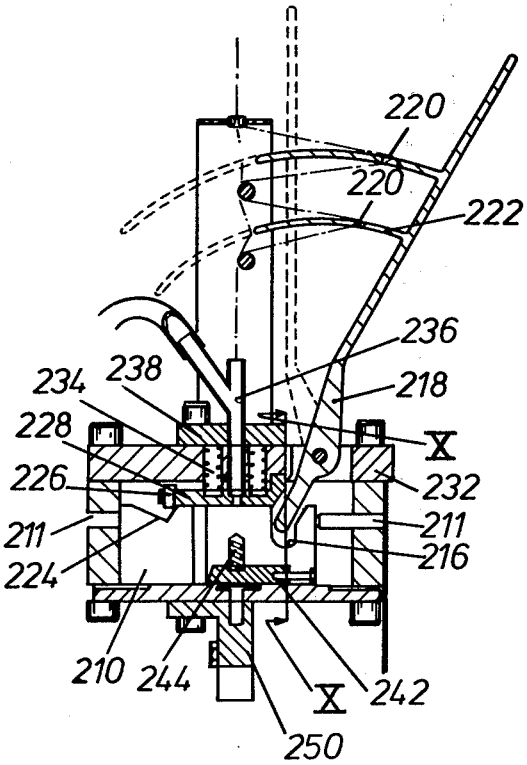
FIG. 9 shows a section along line B-B in FIG. 6 with the sliding block in a trap position.
Figure 11:
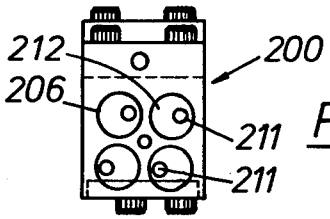
FIG. 11 shows an end view of the mechanism of FIG. 6 with an end plate removed.
Figure 12:
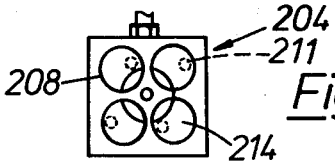
FIG. 12 shows an end view of a return piston housing of the mechanism of FIG. 6.

The plates 210 are retained between dividing walls 213 in the assembly 202 (see FIG. 10). Each plate 210 has three recesses. One recess 216 serves to operate a yarn storage arm 218 having yarn guide apertures 220 in curved sideways extensions 222. The yarn storage arm operates as described previously, the extensions 222 reducing the risk of yarn entanglement. Another recess 224 serves to engage an adjustable pin 226 on a yarn trapping block 228. The yarn trapping block 228 is retained against lengthwise movement by a flange 230 engaged in the top wall 232 of the assembly 202 and urged towards the plate 210 by a pair of springs 234, one on each side of a yarn supply passage 236. The springs 234 are retained by a top cover 238. A further recess 240 holds a cutting knife 242 urged downward by a spring 244. The yarn trapper block 228 and the knife are otherwise arranged in an equivalent manner to that previously described.

Figure 7:
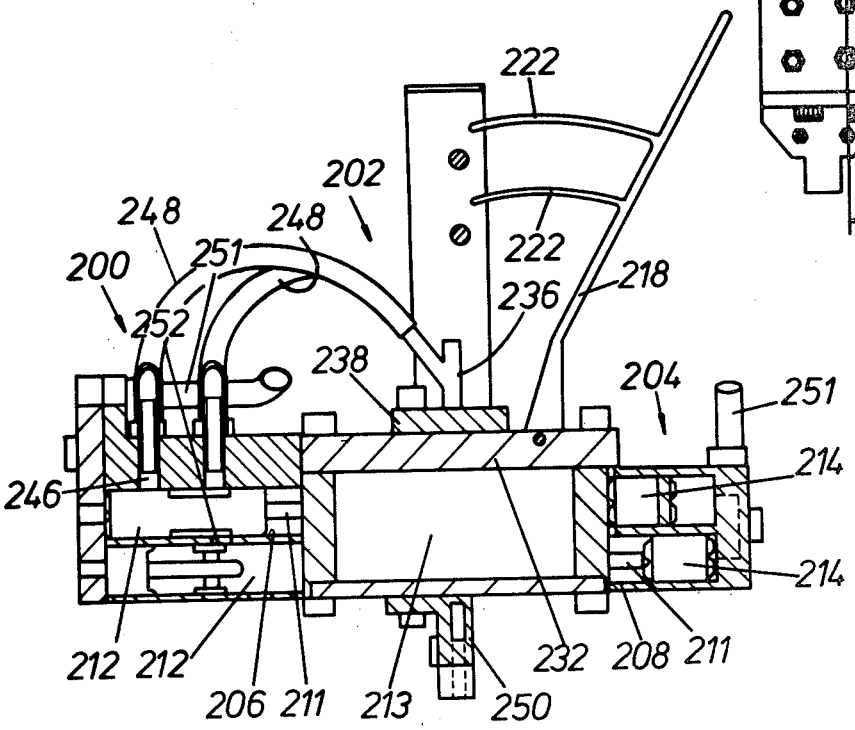
FIG. 7 shows a section along line VII—VII in FIG. 6.
Figure 8:
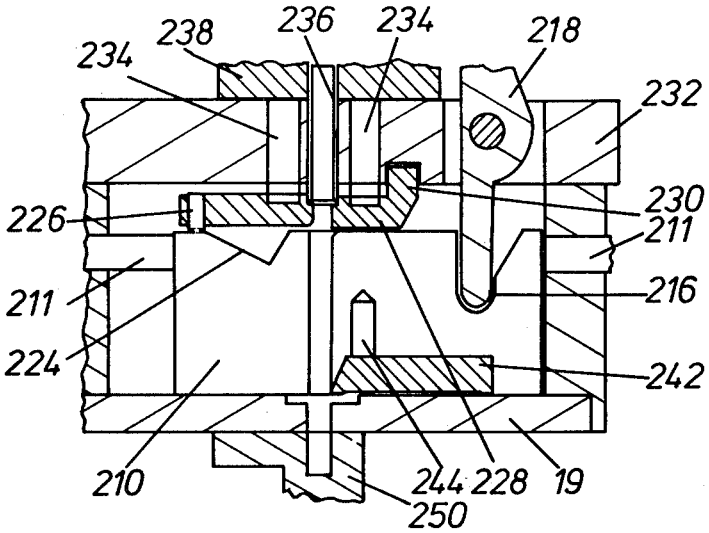
FIG. 8 shows a section along line VIII—VIII in FIG. 6 with the sliding block in a feed position.

Actuation of the mechanism for a yarn change occurs as follows. Compressed air is supplied to the selected piston 212. If the piston 212 is an upper piston as seen in FIG. 7, it will move to the right until the rear edge of the piston 212 uncovers an inlet 246 for a passage 248 leading to the associated passage 236. Thus at the end of the movement when the sliding block 210 has just reached the feed position illustrated in FIG. 8, a blast of air will propel the leading end of yarn to an outlet 250, arranged generally as in the previous embodiment. Just before the inlet 246 is uncovered the pin 226 will engage the slope 224 and lift the trapper block 228 slightly to unclamp the trapped yarn. Thus when the air is blasted down through the plate 210, the leading end of yarn is free to move. Subsequently compressed air is supplied to all pistons 214 through line 251 and the sliding plate 210 previously in the feed position is returned to the trap position. The cutting knife 242 then cuts the trapped yarn. Movement of the sliding plate 210 previously selected is prevented by the air pressure on the corresponding piston 212. After a suitable delay the supply of compressed air to the piston 212 and the pistons 214 is stopped.

The operation is similar if the selected piston 212 is a lower piston, but in that case (see FIG. 7) the air passes through a bore in the piston 212 to an opening 252, past a restricted part of the upper piston to a passage 254 leading to the associated passage 236.

The use of superposed pistons and sliding plates 210 reduces the dimensions of the mechanism considerably. Compressed air is only supplied to the yarn passage 236 whose yarn is to be introduced. The trapper block 228 is released and pressed against the plate 210 giving a more positive trapping and untrapping action. The mechanism makes more efficient use of the air supplied. The knife 242 is urged downward under an independent spring 244 pressure and can be easily replaced when worn. The mechanism can be easily adapted to provide the right sequence of trapping and cutting and untrapping and blasting air through.

We claim:

1. Yarn feed and yarn change mechanism including a plurality of inlet yarn feed passages, a plurality of outlet yarn feed passages one associated with each of the inlet passages, a pneumatic means for providing a flow of fluid from each of the inlet passages to the associated outlet passage, a yarn cutting and trapping arrangement between each of the associated inlet and outlet passages comprising a control element, a yarn control passage in the control element, a trapper between the inlet passage and the control passage, severing means between the control passage and the outlet passage, and means for moving the control elements individually between a feed position in which the control passage joins the inlet and outlet passages and wherein the pneumatic means is able to propel a leading end of yarn to the outlet passage and a trap position in which the control passage holds yarn under the trapper after severing the yarn on moving from the feed to the trap position.

2. A mechanism as claimed in claim 1 in which the pneumatic means includes a branch passage connected to each associated yarn feed passage and inclined with respect thereto to blow compressed air toward the respective control element and the inlet yarn feed passages have a cross-section greater than the yarn control passages.

3. A mechanism as claimed in claim 1 in which each control element is slidably mounted, the trapper forms a guide surface on one side of the control element and is urged toward the control element and a surface on the opposite side of the control element bears against the control element and is adapted to cut the yarn.

4. A mechanism as claimed in claim 1 which includes for each control element a yarn storage arm mounted on a stationary pivot connected on one side of the pivot to the respective associated control element and having at least two longitudinally spaced yarn guides on the other side of the pivot and a yarn guide rod for cooperating with the longitudinally spaced yarn guides of the yarn storage arm to form a yarn store in the trap position of the control element.

5. A mechanism as claimed in claim 1 in which the means for moving the control elements individually comprise a first set of piston and cylinder devices selectively connectable to a source of compressed air to move a selected control element to the feed position and a second set of piston and cylinder devices jointly connectable to a source of compressed air to move all non-selected control elements to the trap position.

6. A mechanism as claimed in claim 5 in which the first set of piston and cylinder devices control valve means for supplying compressed air to the second set.

7. A mechanism as claimed in claim 5 in which the first set of piston and cylinder devices control the pneumatic means for providing a flow of fluid.

8. A mechanism as claimed in claim 5 in which the pistons are arranged one above the other and pins are provided for transmitting the piston movement to the respective control elements, said pins being sideways off-set to actuate control elements arranged side-by-side.

9. A mechanism as claimed in claim 1 in which the control element has a recess, and the trapper has an extension for engaging the recess to apply or release the trapper on movement of the respective control elements in and out of the feed position.

10. A mechanism as claimed in claim 1 in which the control element mounts a knife and a spring urging the knife towards the outlet passage for severing the yarn.

11. Yarn feed and yarn change mechanism including a body having a central portion mounting a plurality of individually slidable control elements, yarn control passages extending through said elements, a plurality of inlet passages each forming at one end an inlet for yarn and terminating at the other end adjacent the associated control element, a plurality of trappers, one between the end of each inlet passage and a top portion of the associated control element, pneumatic means for blowing compressed air down the inlet passage to the control element, severing means at a bottom portion of the respective control elements, and outlet passage means for conveying air and yarn towards a knitting machine when the control passage is aligned with the inlet passage in a feed position; said body further having on one side a first housing for a plurality of pistons a plurality of pistons in said first housing, said pistons serving to slide the respective control elements in one direction, a second housing for another plurality of pistons on the other side of said body, a second plurality of pistons in said second housing, said second plurality of pistons serving to slide the respective control elements in the opposite direction.

12. A mechanism as claimed in claim 11 in which the inlet yarn feed passages have a cross-section greater than the yarn control passages.

13. A mechanism as claimed in claim 11 which includes for each control element a yarn storage arm mounted on a stationary pivot connected on one side of the pivot to the respective associated control element and having at least two longitudinally spaced yarn guides on the other side of the pivot and a yarn guide rod for cooperating with the longitudinally spaced yarn guides of the yarn storage arm to form a yarn store in the trap position of the control element.

14. A mechanism as claimed in claim 11 which includes a first set of piston and cylinder devices selectively connectable to a source of compressed air to move a selected control element to the feed position on the one side and a second set of piston and cylinder devices jointly connectable to a source of compressed air to move all non-selected control elements to the trap position on the other side, the first set controlling the pneumatic means and the pistons being one above the other and pins are provided for transmitting the piston movement to the respective control elements, said pins being sideways off-set to actuate control elements arranged side-by-side..

15. A mechanism as claimed in claim 11 in which the control element has a recess and the trapper has an extension for engaging the recess to apply or release the trapper on movement of the respective control elements in and out of the feed position and the control element mounts a knife and a spring urging the knife towards the outlet passage for severing the yarn.

16. A yarn feed and yarn change mechanism for selectively delivering one of a plurality of different yarn strands comprising a plurality of side-by-side inlet yarn feed passages, a plurality of outlet yarn feed passages one associated with each of the inlet passages, a pneumatic means for providing a flow of fluid from each of the inlet passages to the associated outlet passage, a yarn cutting and trapping arrangement between each of the associated inlet and outlet passages comprising a control element, a yarn control passage in the control element, a trapper between the inlet passage and the control passage, severing means between the control passage and the outlet passage, a plurality of drive means, one associated with each inlet and outlet passage for moving the control elements individually between a feed position in which the control passage joins the inlet and outlet passages and wherein the pneumatic means is able to propel a leading end of yarn to the outlet passage and a trap position in which the control passage holds yarn under the trapper after severing the yarn on moving from the feed to the trap position, and programmable control means for energizing one of said drive means individually to move a corresponding control element to the feed position while holding the control elements for each of the other inlet tubes in the trap position.

17. A mechanism as claimed in claim 16 wherein the programmable control means includes a pattern band, means for moving said band in synchronism with a knitting operation and signal means selectively actuated by said band energizing said one of said drive means.

18. A mechanism as claimed in claim 17 wherein the pattern band carries holes at preselected positions thereon and the signal means includes a light source and a plurality of photocells on opposite sides of the tape, said photocells energized by light passing through the pattern band holes, and preset timer means actuated by said photocells energizing one of said drive means for a preselected time to move a corresponding control element to feed position.

* * * * *

UNITED STATES PATENT AND TRADEMARK OFFICE

CERTIFICATE OF CORRECTION

PATENT NO. : 4,137,732
DATED : February 6, 1979
INVENTOR(S) : Daniel W. F. Gostelow and Peter M. Findlay It is certified that error appears in the above-identified patent and that said Letters Patent are hereby corrected as shown below:

Column 1, line 54, "strap" should be --trap--.

Column 1, line 63, "passage" should read --passages--.

Column 9, line 23, "Yd" (first occurrence) should be --Yb--.

Signed and Sealed this

*Twenty-sixth* Day of *June 1979*

[SEAL]

*Attest:*

RUTH C. MASON
*Attesting Officer*

DONALD W. BANNER
*Commissioner of Patents and Trademarks*